United States Patent [19]

Maan

[11] Patent Number: 5,011,419

[45] Date of Patent: Apr. 30, 1991

[54] SAFETY SOCKET

[76] Inventor: Jack Maan, 4 Fl., No. 7-1, Chung Yang Erh St., Hsin Tien City, Taipei Hsien, Taiwan

[21] Appl. No.: 454,173

[22] Filed: Dec. 21, 1989

[51] Int. Cl.[5] ..... H01R 13/44

[52] U.S. Cl. ..... 439/145; 439/137; 439/140

[58] Field of Search ..... 439/136, 140, 145–147, 439/271, 367, 373

[56] References Cited

U.S. PATENT DOCUMENTS

| | | | |
|---|---|---|---|
| 2,820,842 | 1/1958 | Meistrell | 439/145 |
| 4,600,258 | 7/1986 | Hu | 439/140 |
| 4,798,916 | 1/1989 | Engel et al. | 439/137 |

*Primary Examiner*—Paula A. Bradley

*Attorney, Agent, or Firm*—Merchant, Gould, Smith, Edell, Welter & Schmidt

[57] ABSTRACT

A safety socket includes a cover plate having an opening, a spring-biased stepped plate, and a base plate having a first recessed portion for fixedly receiving the cover plate and a second recessed portion within which the stepped plate is slidable. Both the stepped plate and the base plate include a respective pair of hot slots. The stepped plate includes a raised plate which is designed to cooperate with the opening of the cover plate so that the raised plate is displaceable within the opening of the cover plate from a safety position, where the pair of hot slots on the stepped plate blocks the pair of hot slots on the base plate, to a work position, where the two pairs of hot slots are aligned for receiving a plug.

3 Claims, 3 Drawing Sheets

SAFETY SOCKET

BACKGROUND OF THE INVENTION

The present invention relates generally to safety sockets for plugs. More particularly, the present invention relates to wall sockets which are served as safeguards for power source outlets and are ready for receiving plugs.

A similar type of safe socket is disclosed in U.S. Pat. No. 4,600,258 to Hu. In Hu '258, the safety socket primarily comprises a stationary hood, a slidable board and a stationary socket body. Since the slidable board is covered by the stationary hood, a groove has to be provided on a side of the socket so that an extension, or a handle, of the slidable board can be employed by the user to align the pair of hot slots on the slidable board with both the pair of hot slots on the stationary hood and the pair of hot slots on the stationary socket body. Moreover, to use this kind of socket, the user has to pull the slidable board with one hand and simultaneously insert the plug with the other hand.

To improve the type of safety socket described above, the present invention employs innovations which do not require the addition of elements like the stationary hood and the stationary body as in Hu '258 and which has simplified the design of the slidable board. Further with the exposure of the pair of hot slots on the slidable plate according to the present invention, only one hand is required by the user to operate the safety socket of the present invention.

SUMMARY OF THE INVENTION

A primary objective of the present invention is to provide a safety socket which can be operated with only one hand and which is of simplified design and construction.

Further objectives and advantages of the present invention will become apparent as the following description proceeds, and the features of novelty which characterize the invention will be pointed out with particularity in the claims annexed to and forming a part of this invention.

DETAILED DESCRIPTION OF THE PREFERRED EMBODIMENT

Figure 1:
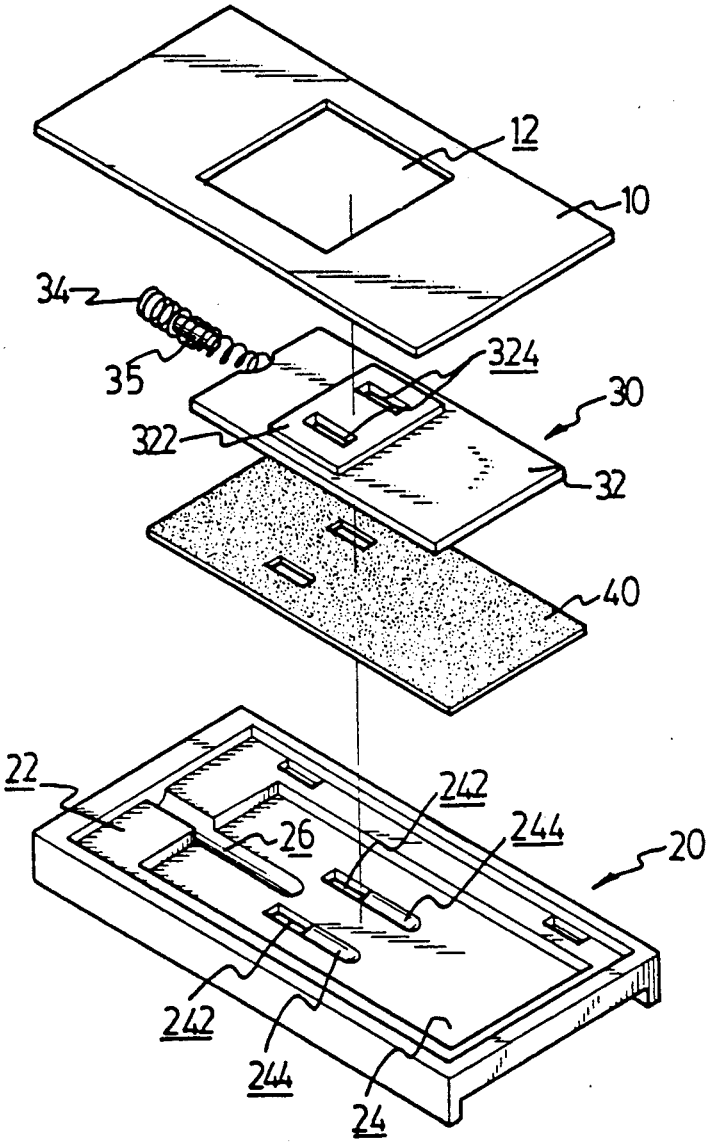
FIG. 1 is an exploded view of a safety socket in accordance with the present invention.

Referring now to the drawings, and more particularly to FIG. 1, there is shown the safety socket which comprises a cover plate 10 having a rectangular opening 12 thereon, a base plate 20 having a first recessed portion 22 and a second recessed portion 24 formed on the first recessed portion 22, a sliding means 30 comprising a stepped plate 32 for mounting in the second recessed portion 24, and a combination spring 34 and guide-rod 35 abutting one end of the stepped plate 32.

Figure 2A:
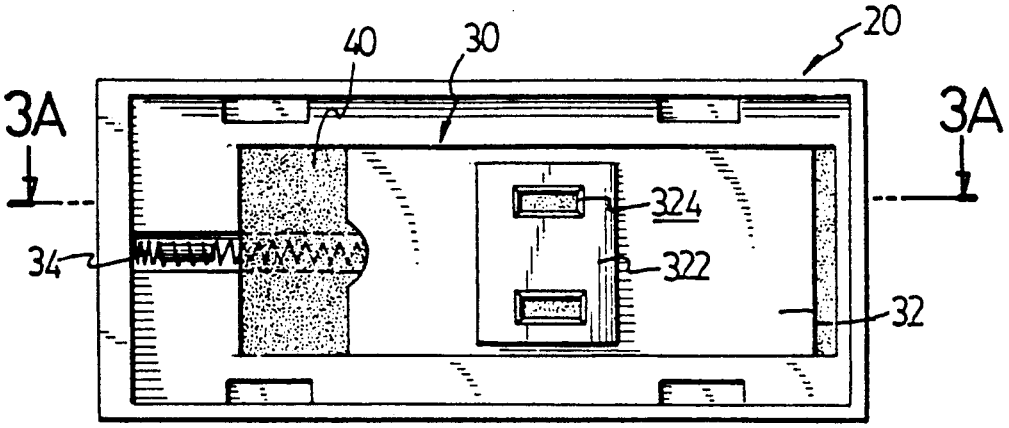
FIG. 2A is a top elevational view of the safety socket in accordance with the present invention shown in a safety position, with the cover plate removed for clarity.
Figure 2B:
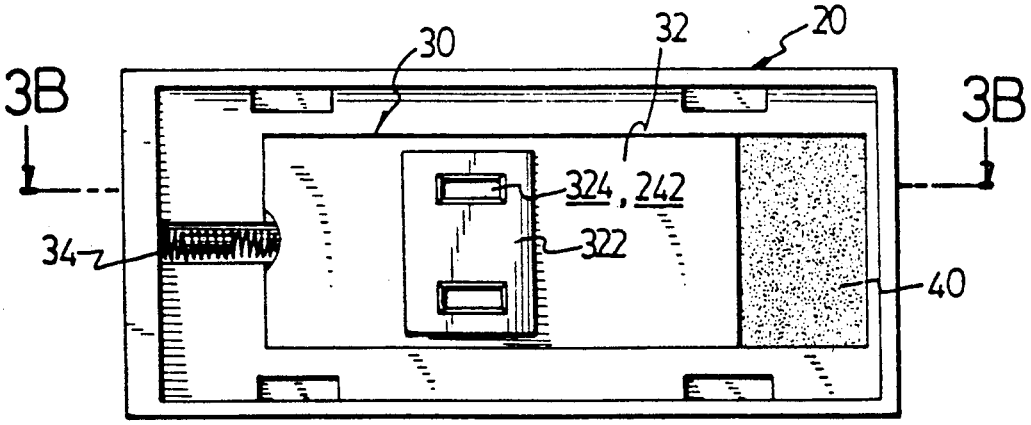
FIG. 2B is a view similar to FIG. 2A but showing the safety socket in a work position.

The substantially rectangular base plate 20 includes the first recessed portion 22 adapted for fixedly receiving the cover plate 10. The second recessed portion 24, which is smaller in size than the first recessed portion 22, has a pair of hot slots 242 therein. The stepped plate 32 has a raised plate 322 extending from a top surface thereof. When the safety socket of this invention is assembled, with the cover plate 10 disposed over the sliding means 30, the raised plate 322 is confined by and displaceable between two limit positions within the opening 12 of the cover plate 12, as shown in FIGS. 2A and 2B.

Figure 3B:
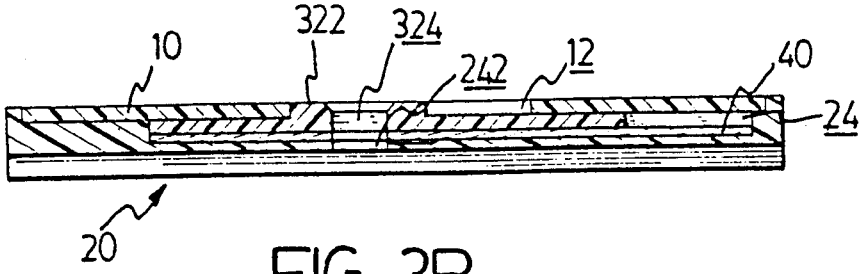
FIG. 3B is a view similar to FIG. 3A but taken along line 3B—3B in FIG. 2B and with the plug removed.
Figure 3A:
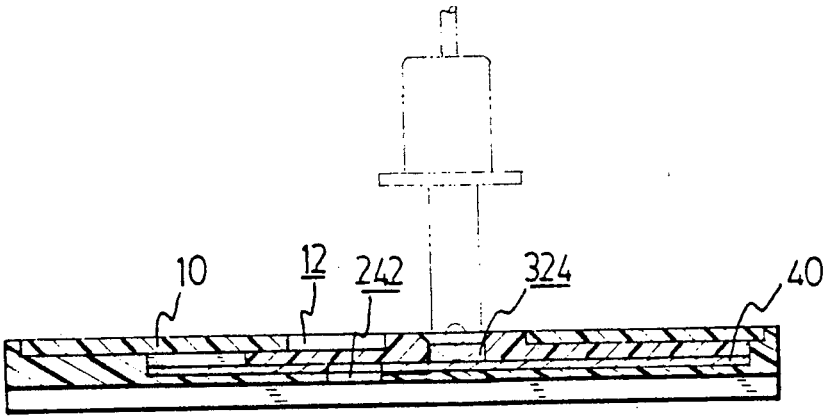
FIG. 3A is a cross-sectional view taken along line 3A—3A in FIG. 2A, with the cover plate mounted and a plug incorporated.

The stepped plate 32 of the sliding means 30 which is shorter in length than the second recessed portion 24 is received within the second recessed portion 24 in a slidable manner so that the stepped plate 32 is displaceable between two limit positions within the second recessed portion 24 of the base plate 20. As the raised plate 322 is displaceable within the opening 12 of the cover plate 10, the stepped plate 32 is also slidable from a safety position to a work position, with the safety position of the stepped plate 32 corresponding to one of the two limit positions and the work position corresponding to the other of the two limit positions. Depending on the design for lengths of the opening 12, the raised plate 322 and the stepped plate 32, the rest and work positions for the stepped plate 32 may be designed to correspond with the two limit positions for either the raised plate 322 or the stepped plate 32. In this embodiment the rest and work positions are preferably defined by the two limit positions for the raised plate 322 of the stepped plate 32 within the opening 12 of the cover plate 10, as shown in FIGS. 3A and 3B.

The stepped plate 32 also includes a pair of hot slots 324 substantially disposed in a center of the raised plate 322. The combination spring 34 and guide-rod 35 is received in a channel 26 provided on the base plate 20. The channel 26 is disposed within the second recessed portion 24 and extending toward a side wall of the base plate 20 in the direction in accordance with the sliding movement of the stepped plate 32. When the safety socket of this invention is assembled, the raised plate 322 of the stepped plate 32 is slidable from the safety position, shown in FIG. 2A, where the pair of hot slots 242 on the base plate 20 are blocked by the stepped plate 32 to the work position, shown in FIG. 2B, where the pair of hot slots 242 on the base Plate 20 are aligned with the pair of hot slots 324 on the stepped plate 32. When the safety socket of this invention is in the safety position, the stepped plate 32 is urged (rightward) by the spring 34 to block the pair of slots 242 on the base plate 20. When the safety socket of this invention is in the work position, the plate assembly 32 is manually forced (leftward) to compress the spring 34 and, simultaneously, allow the insertion of a plug (only shown FIG. 3A by imaginary line) through the aligned two pairs of hot slots on the stepped plate 32 and the base plate 20, respectively. As clearly seen from FIGS. 2A and 2B, a notch is formed on one end of the stepped plate 32 for positioning the spring 34.

A specific feature of the present invention is that the sliding means 30 can be manually moved from the safety position to the work position by only one hand. With this in mind, to facilitate the insertion operation of a plug (shown in FIG. 3A by imaginary line), a trough 244 is further disposed proximate to each of the pair of slots 242 on the base plate 20. The trough 244 has a length substantially equal to the length of the adjacent slot 242. It is noted that when moving the sliding means 30 by only one hand, first inserting the plug into the pair of hot slots 324, the plug will be more smoothly and easily inserted into the pair of hot slots 242 of the base plate 20 below. Consequently, the trough 244 will aid in facilitating the plug's insertion operation of the plug.

Preferably, the safety socket of this invention comprises a seal sheet 40 disposed between the sliding means 30 and the base plate 20. The seal sheet 40 also has a pair of hot slots which when mounted within the second recessed portion 24 are in line with the pair of hot slots 242 on the base plate 20. The seal sheet 40 is made of plastics or a comparable material so that when in the safety position water is prevented from entering the pair of hot slots 242 of the base plate 20. The safety socket of this invention is thus guarded from water damage and may be disposed on outside of a building as is desired. However, with the utilization of the seal sheet 40 the trough 244 will be covered and unused.

While the present invention has been explained in relation to its preferred embodiment, it is to be understood that various modifications thereof will be apparent to those skilled in the art upon reading this specification. Therefore, it is to be understood that the invention disclosed herein is intended to cover all such modifications as shall fall within the scope of the appended claims.

I claim:

1. A safety socket comprising:

a cover plate having a rectangular opening thereon;

a base plate having a first recessed portion for receiving said cover plate, a second recessed portion being formed on said first recessed portion, said second recessed portion having a first pair of hot slots therein; and a sliding means comprising a stepped plate and a combination of a spring and a guide-rod, said stepped plate having a raised plate extending from a top surface at a substantially intermediate position thereof and a second pair of hot slots thereon, said combination of spring and guide-rod being received in a channel provided on said base plate, said raised plate being confined to be displaceable within said opening of said cover plate, said stepped plate being slidable within said second recessed portion from a safety position where said first pair of hot slots are blocked by said second pair of hot slots to a work position where said first pair of hot slots are aligned with said second pair of hot slots.

2. A safety socket as claimed in claim 1, wherein a trough is disposed proximate to each slot of said first pair of slots on said base plate, said trough having a length substantially equal to the length of said adjacent slot to facilitate an insertion operation of a plug.

3. A safety socket as claimed in claim 1, further comprising a seal sheet having a pair of third hot slots thereon, said seal sheet being disposed within said second recessed portion of said base plate with said third pair of hot slots aligned with said first pair of hot slots of said base plate.

* * * * *